United States Patent [19]

Allen

[11] Patent Number: 4,490,076

[45] Date of Patent: Dec. 25, 1984

[54] UNDERGROUND SUPPORT DEVICES

[75] Inventor: Archelaius D. Allen, Preston, England

[73] Assignee: Dobson Park Industries PLC., Nottingham, England

[21] Appl. No.: 423,096

[22] Filed: Sep. 24, 1982

[30] Foreign Application Priority Data

Nov. 14, 1981 [GB] United Kingdom ..... 8134376

[51] Int. Cl.[3] ..... E21D 15/30; E21D 15/44

[52] U.S. Cl. ..... 405/289; 405/291

[58] Field of Search ..... 405/289, 290, 291, 292, 405/293, 294, 296, 298, 299; 91/170 MP; 248/354 H, 357; 299/33

[56] References Cited

U.S. PATENT DOCUMENTS

| | | | |
|---|---|---|---|
| 2,861,429 | 11/1958 | Duncan | 405/289 |
| 3,881,776 | 5/1975 | Fashbaugh et al. | 405/289 X |
| 3,890,792 | 6/1975 | Alacchi | 405/298 |

FOREIGN PATENT DOCUMENTS

| | | | |
|---|---|---|---|
| 2533608 | 9/1976 | Fed. Rep. of Germany | 405/292 |
| 378630 | 7/1973 | U.S.S.R. | 405/289 |
| 473837 | 9/1975 | U.S.S.R. | 405/289 |
| 653396 | 3/1979 | U.S.S.R. | 405/289 |
| 773282 | 10/1980 | U.S.S.R. | 405/289 |

*Primary Examiner*—David H. Corbin

*Attorney, Agent, or Firm*—Quaintance & Murphy

[57] ABSTRACT

An underground support, e.g. for the roof of a mine, has a roof engaging canopy 10 which can be raised and lowered in a controlled manner by hydraulic legs 14. Inflatable flexible membrane means, for example in the form of bags 12, are provided on the upper face of the canopy 10, which shape themselves to the mine roof and distribute loading evenly thereto. Inflatable flexible membrane means may also be used to prevent flushing of loose debris between adjacent supports, and on roadway supports.

17 Claims, 15 Drawing Figures

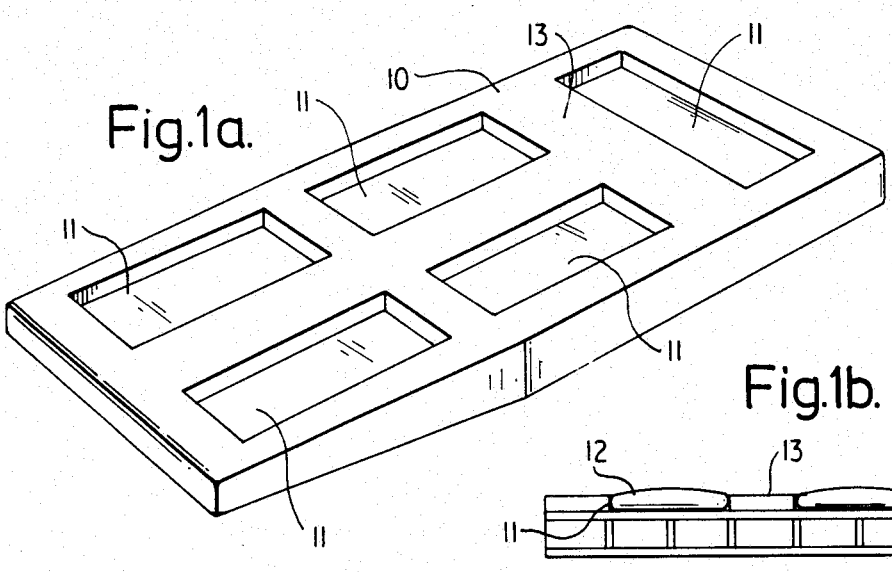
Fig.1a.
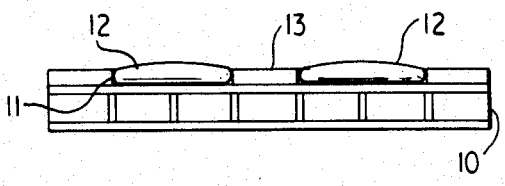
Fig.1b.
Fig.1c.
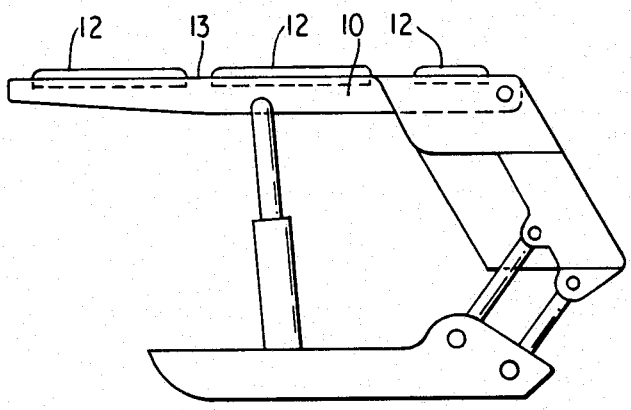
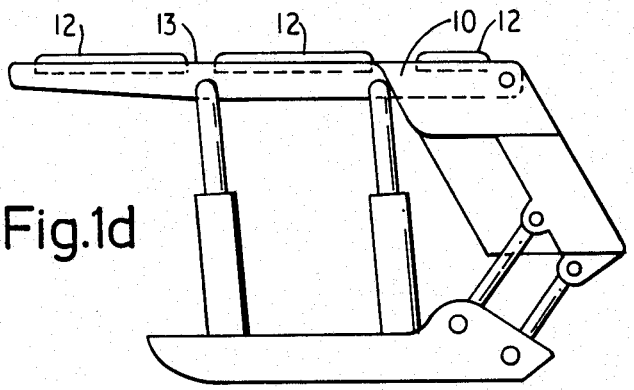
Fig.1d

UNDERGROUND SUPPORT DEVICES

BACKGROUND TO THE INVENTION

The invention relates to underground support devices such as roof supports and roadway supports for use in mines.

With such supports problems arise in achieving support contact over a wide area, particularly where the surface to be supported is loose and/or uneven. It is known to pack uneven areas, for example with pieces of timber or some settable medium such as a cement compound, but this is inconvenient and time consuming.

DESCRIPTION OF THE PRIOR ART

Attempts have been made to overcome the problem in various ways. Supports have been made of spring steel with a view to making the supports more able to shape themselves to conform to the shape of the surface that they are supporting, but this has not been wholly satisfactory as the supports can only be given very limited flexibility. Articulated supports have also been made but the number of articulation points that can be provided is very limited, and mere point or line contact often results.

Russian Pat. No. 769008 discloses the use of doubled over tubes closed by bungs which can be expanded by air to support a mine roof right at the front of a mine roof support canopy but there is only very limited contact between the tubes and the mine roof and the patent does not solve the above mentioned problem. The canopy itself is raised pneumatically.

U.K. Patent Specification No. 876872 discloses a mine roof support having pneumatic cushions thereon but the support has pneumatic legs which have to be mechanically locked in position.

OBJECT OF THE INVENTION

It is the object of the invention to provide an underground support device which has the strength and versatility of hydraulic operation and which overcomes or alleviates the aforesaid problem.

SUMMARY OF THE INVENTION

The invention provides an underground support device comprising:

(a) hydraulic drive means;

(b) a substantially rigid support structure movable by the hydraulic drive means between a first position in which the substantially rigid support structure is spaced away from a surface to be supported and a second position in which the substantially rigid support structure is adjacent to the said surface;

(c) control means controlling said hydraulic drive means;

(d) flexible membrane means mounted on said rigid support structure;

(e) fluid pressure means operable to inflate the membrane, hence shaping the flexible membrane means to said surface and distributing the loading evenly thereto.

The flexible membrane means may comprise at least one inflatable bag.

Alternatively it may comprise a sheet of material sealed to the support structure around its edges.

The flexible membrane may be constructed of flexible synthetic material, for example Neoprene, with reinforcing means, for example woven steel mesh, embedded therein.

The underground support device may comprise a hydraulic roof support having a base, a roof engaging unit (e.g. a beam or canopy) and at least one hydraulic leg extending between the base and the roof engaging unit, the flexible membrane means being mounted on the upper face of the roof engaging unit.

The flexible membrane means may be mounted or located in a recess in the roof engaging unit, and the depth of the recess and the thickness of the uninflated flexible membrane means may be such that in the uninflated condition the flexible membrane means does not project above the upper face of the roof engaging unit.

The flexible membrane means may be inflatable as a separate operation from hydraulic operation of the leg, for example so that after the roof engaging unit has been set against the surface to be supported with a predetermined pressure, the flexible membrane means can be inflated either automatically or by an operative to fill any gaps between the roof engaging unit and the surface to be supported.

Alternatively, the flexible membrane means may be inflatable as an operation related to the hydraulic operation of the leg.

For example the inflatation of the flexible membrane means may be controlled by a valve which comes into operation when the pressure in the leg reaches a predetermined value.

A separate fluid supply may be provided for the flexible membrane means. For example the leg may be supplied with relatively high pressure fluid (e.g. hydraulic fluid at a pressure of up to 2000 or 3000 p.s.i.) whereas the flexible membrane means may be supplied with relatively low pressure fluid (e.g. air or water at a pressure of from 50 p.s.i. to 120 p.s.i. or possibly 100 p.s.i. to 150 p.s.i.) from a separate supply line or via a reducing valve.

The fluid supply circuit for the flexible membrane means and the fluid supply circuit for the leg may be linked together such that lowering the leg causes the pressure and volume of fluid in the flexible membrane means to fall and the flexible membrane means to at least partially empty, and raising the leg causes the pressure and volume of fluid in the flexible membrane means to rise.

The pressure in the flexible membrane means may be controlled such that if it rises above a predetermined limit, the leg lowers slightly to reduce the pressure and/or volume in the flexible membrane means.

The flexible membrane means may be secured to the roof engaging unit by means of a non-inflatable part or portion through which a bolt hole may be provided. Alternatively, a non-inflatable portion may be provided to accommodate a strap attached to the roof engaging unit at each end and passing over the non-inflatable portion of the flexible membrane means.

This type of attachment is particularly desirable when the support to be used is a 'contact-advance' method where the roof engaging unit would not be lowered from the roof or other supported surface during the advancing sequence, and where there is a tendency to dislodge the flexible membrane means during such advancing sequence.

The flexible membrane means may be mounted at at least one side of a hydraulic roof support to provide side sealing between adjacent supports, to reduce the risk of flushing.

The flexible membrane means may be mounted on an extension bar which is extendable from the roof engaging unit of a hydraulic roof support.

The extension bar may comprise a channel member with the mouth of the channel facing upwardly, the flexible membrane means being accommodated in the channel.

The underground support device may comprise a roadway support of the type having hydraulic legs and being advancable with the roadway heading.

The roadway support may be an arched support or a square work support and may embody a series of roof or wall engaging structures adapted to accommodate a membrane or membranes.

Other objects, preferred features and advantages of the invention will become apparent from the following description of embodiments of the invention:

BRIEF DESCRIPTION OF THE DRAWINGS

FIG. 1*a* is a perspective view of the roof canopy of a hydraulic roof support chock according to the invention;

FIG. 1*b* is a cross-section through the canopy of FIG. 1*a*, showing inflatable bags mounted on the roof canopy;

FIG. 1*c* is a side view of a two-leg chock fitted with the canopy shown in FIGS. 1*a* and 1*b*;

FIG. 1*d* is a side view of a four-leg chock fitted with the canopy of FIGS. 1*a* and 1*b*;

DESCRIPTION OF EMBODIMENTS OF THE INVENTION

Referring firstly to FIGS. 1*a* to 1*d*, there is shown the roof canopy 10 of a hydraulic roof support chock, the canopy being conventional except for the provision of five recesses 11. As best seen in the cross-sectional view of FIG. 1*b*, each recess contains a flexible membrane in the form of an inflatable bag 12. The material from which each bag is constructed comprises layers of Neoprene laminated with layers of woven steel reinforcement mesh.

The bags can be mounted on the roof beam or roof canopy of any hydraulic chock, for example a two-leg hydraulic chock as shown in FIG. 1*c*, or a four-leg hydraulic chock as shown in FIG. 1*d*. The depth of the recesses 11, and the thickness of the uninflated bags, is such that when the bags are in the uninflated condition, they do not project above the upper face 13 of the canopy. Thus the chocks can be placed in position, and moved to a new position, in the conventional manner, and once the chocks have been set, with a predetermined high hydraulic pressure in the legs, the bags can be inflated to fill any gaps between the roof being supported and the roof canopy, such as frequently occur when the roof is uneven. Thus the provision of the bags enables the roof canopy as a whole to shape itself to conform to the shape of the roof which it is supporting and distribute the load evenly thereover.

The bags may be under the control of a valve which is operated manually, or automatically. The valve may for example be opened by means of a plunger positioned on the roof canopy so that when the canopy touches a roof to be supported the plunger is depressed.

The bags may be retained in the recesses by means of struts or other retaining means passing over the bags, or alternatively fixing points such as lugs and/or bolt-holes may be provided on the bags. For example lugs or bolt holes may be incorporated in the steel reinforcement of the bags, around the sealed periphery of the bags.

Figure 2:
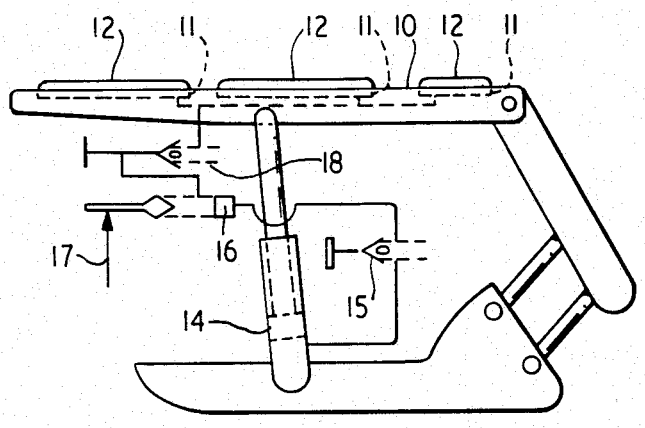
FIG. 2 is a side view of an alternative embodiment of chock according to the invention.

FIG. 2 shows an alternative embodiment of chock which also has a roof canopy 10, recesses 11, and inflatable bags 12. In this case however a tapping from the hydraulic circuit of the legs 14 passes via a pressure relief valve 15 to a bag control valve 16. When the hydraulic pressure rises above a predetermined limit, the valve 16 is opened, allowing air or low pressure water to pass from a supply line 17 via a pressure relief valve 18 to the bags 12.

Thus the bags automatically inflate after the roof canopy has engaged the roof. The valve 16 may for example be set to operate when the hydraulic pressure in the legs has risen by 200 to 300 p.s.i. more than the pressure required in free air to raise the canopy but adequate to prevent the inflating of the legs causing a retraction of the legs.

This embodiment may also enable a wide range of setting pressures to be applied to the roof. With a totally rigid canopy, although there may be localised high concentrations of load (e.g. a ridge giving line contact might produce a concentrated load of 50 or 60 tons across such a line, the average pressure on the roof canopy may be of the order of 50 p.s.i. However the bags may be inflated to a pressure of anywhere from say 50 p.s.i. to 120 p.s.i., so that the bags may be used to increase the pressure and distribute the loading evenly on the roof, without altering the conditions under which hydraulic fluid is supplied to the legs, or altering the conditions which affect the automatic and controlled lowering of the legs as the roof which is being supported settles or converges.

Figure 3:
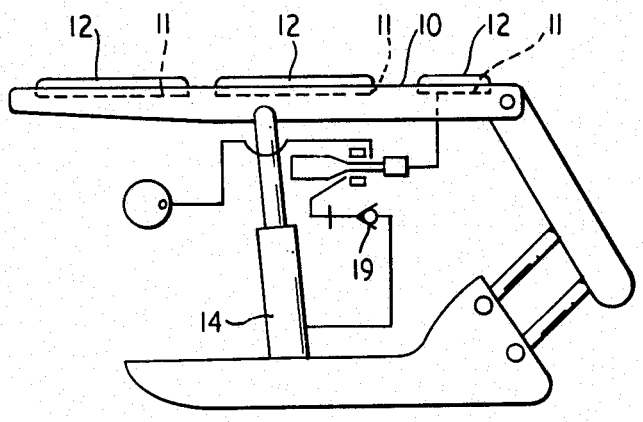
FIG. 3 is a side view of a further embodiment of chock according to the invention.

FIG. 3 illustrates yet another embodiment of chock having a roof canopy 10, recesses 11, and bags 12. In this case the bags 12 are linked to the hydraulic circuit of the legs 14 by means of an isolating valve 19 and the valve 20 which brings about controlled lowering of the legs.

With this embodiment the bags can remain at least partially inflated at all times, and can provide some roof contact support during advance of the chock from one position to another. When the chock is first set, the application of pressure to the legs to raise the legs causes the bags to inflate and shape themselves to the roof as necessary.

When the chock is to be advanced, the legs are lowered slightly, and operation of the valve 20 permits fluid to flow out of the bags until the bags have deflated sufficiently to permit movement of the chock. Further lowering of the legs then ceases, whereupon there is no further pressure drop in the bags and the chock can be advanced with the reduced pressure in the bags giving some degree of contact support to the roof as the chock advances. The pressure in the bags may for example be reduced to anything between 0 and 50 p.s.i.

The valve 20 may be such that should the bag pressure exceed a desired figure during the advancing operation, the legs would automatically lower a little bit further to give an appropriate pressure reduction in the bags.

Figure 4A:
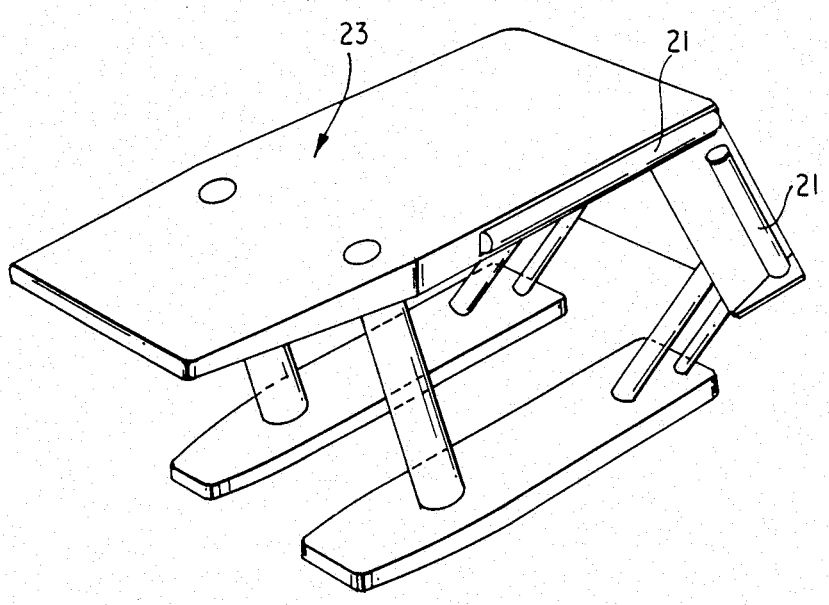
FIG. 4*a* is a perspective view of yet another embodiment of chock according to the invention.
Figure 4B:
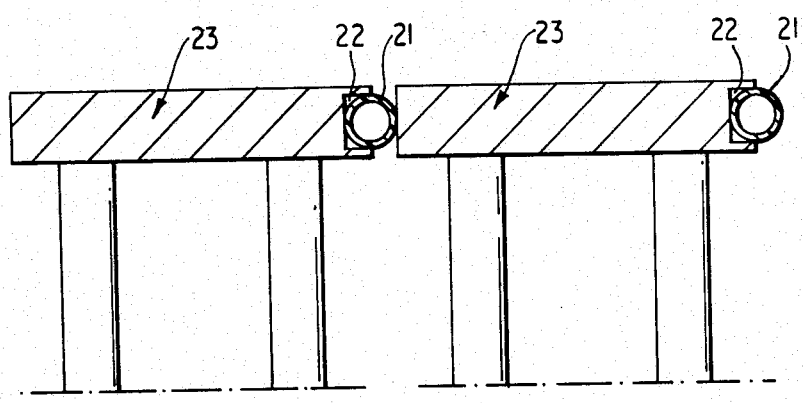
FIG. 4*b* is a diagrammatic cross-section illustrating the use of the embodiment shown in FIG. 4*a*.

FIGS. 4*a* and 4*b* illustrate an alternative embodiment of chock in which cylindrical inflatable bags 21 are mounted in recesses 22 at one side of each of a series of chocks 23. When the chocks are placed in position side by side in a row, the bags 21 can be inflated to seal gaps between adjacent chocks either in their set position or during their advance, as shown in FIG. 4*b*, and thus prevent loose roof material from falling down between the chocks, i.e. flushing.

Figure 5A:
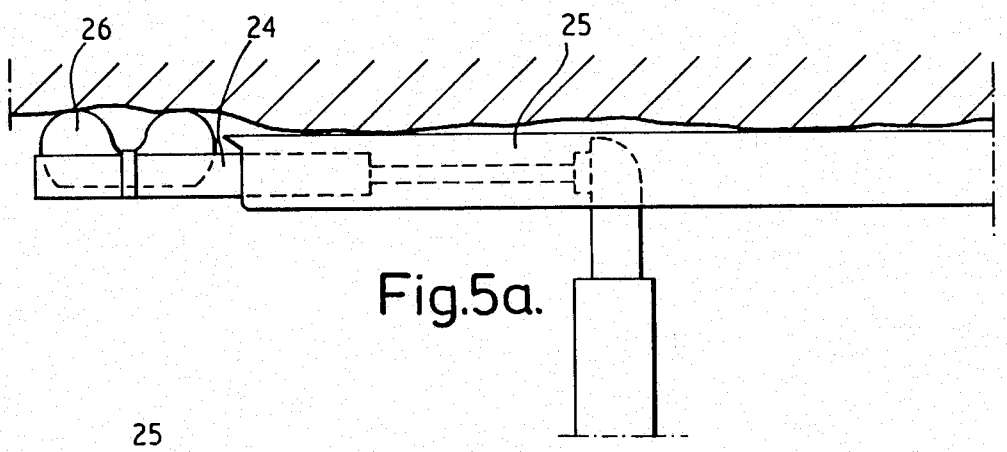
FIGS. 5*a*, 5*b*, and 5*c* are respectively a side view, perspective view, and cross-section illustrating an embodiment of the invention applied to an extension bar of a roof canopy of a chock.
Figure 5B:
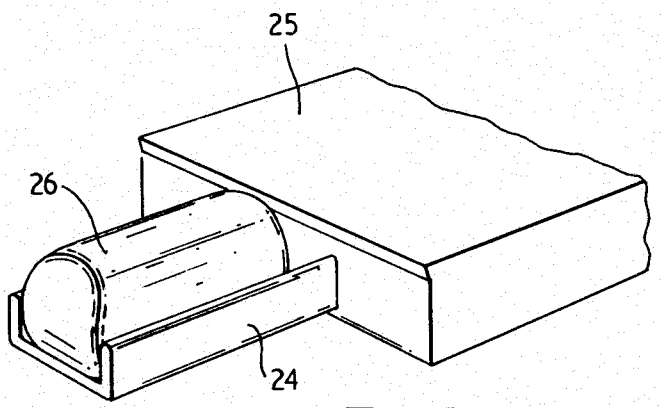
Figure 5C:
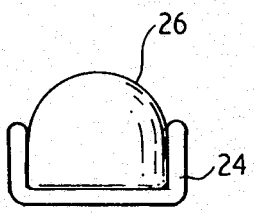

FIGS. 5*a* to 5*c* illustrate yet another embodiment, applied to the extension bar 24 of a roof canopy 25. The extension bar 24 is conventional except that it is formed as a channel member, with the mouth of the channel facing upwardly, and a cylindrical inflatable bag 26 is fitted into the channel.

Not only may such a bag be useful in giving a more even distribution of load to the roof, but the dimensions of the bag may be chosen so that in certain circumstances they can provide an added degree of lift in the region of the extension bar, for example as shown in FIG. 5*a*. In this case the fluid supply to the bag may be associated with the hydraulic circuit which is used to operate the extension bar.

Figure 6A:
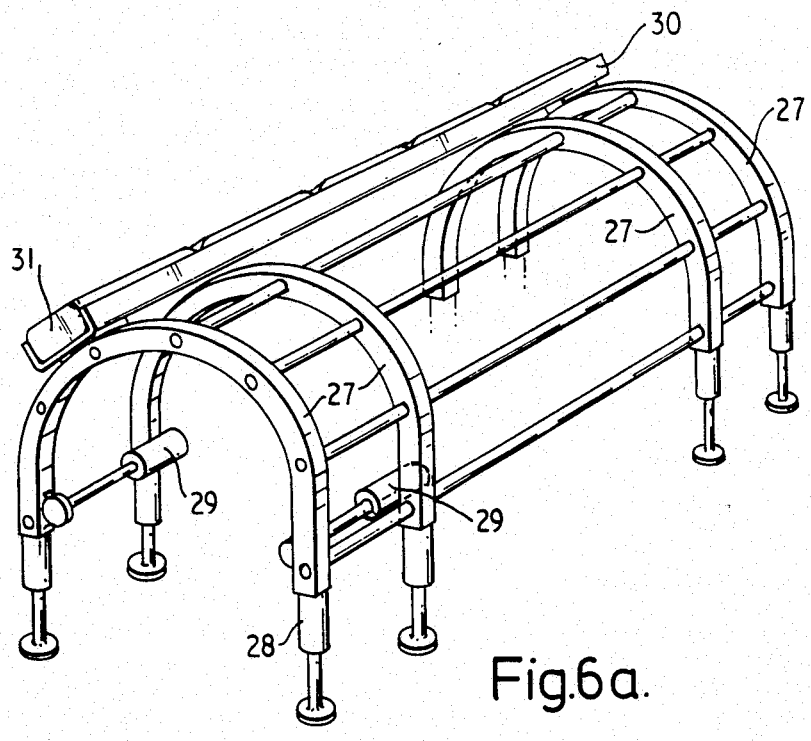
FIGS. 6*a* and 6*b* are respectively a perspective view and a side view illustrating an embodiment of the invention applied to arched roadway supports.
Figure 6B:
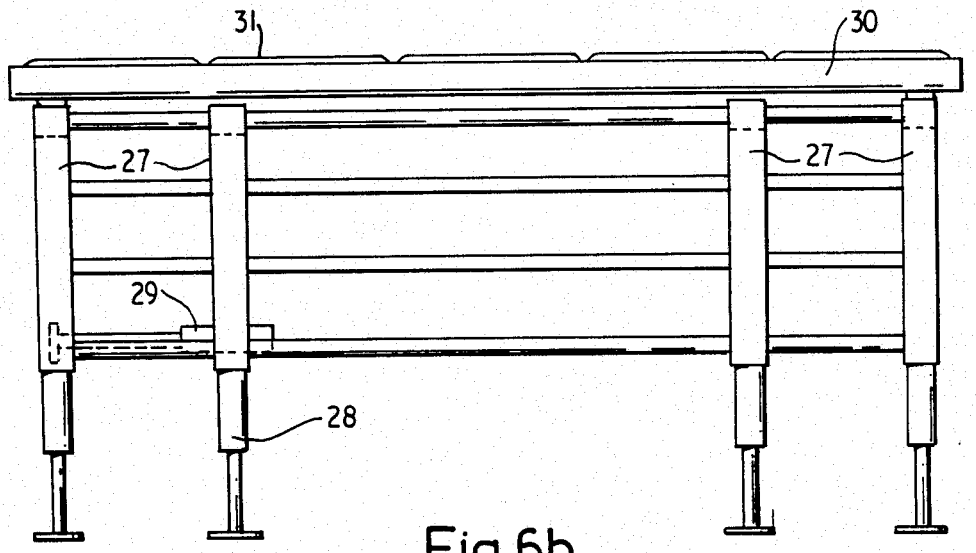

FIGS. 6*a* and 6*b* show yet another embodiment of the invention applicable to arched roadway supports. The support comprises a series of arches 27 having hydraulically operated support legs 28. The left hand arch 27 as viewed in FIGS. 6*a* and 6*b* can be moved relative to the other arches by means of advancing rams 29. Mounted around the periphery of the arches is a series of spaced-apart channel members, only one, 30, being shown in the Figures for the sake of simplicity. Each channel 30 contains an elongate flexible inflatable bag 31.

The arches can be positioned a few inches away from the roof of a roadway by adjustment of the legs 28, and then this few inches of clearance can be removed by inflating the bags to support the roof of the roadway. If it is then desired to advance the supports along a roadway, there is no need to adjust the legs 28. It is only necessary to deflate the bags to give the few inches clearance again, move the support as necessary, and re-inflate the bags.

Figure 7A:
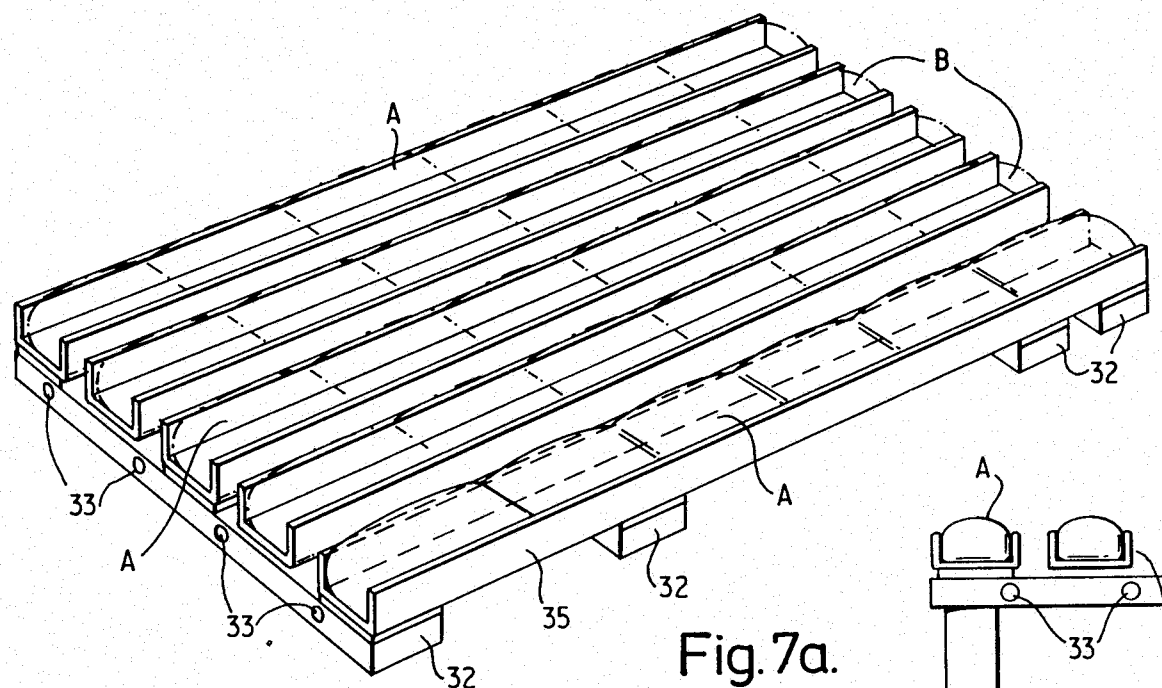
FIGS. 7*a* and 7*b* are respectively a perspective view and an end view illustrating an embodiment of the invention applied to square work roadway supports.
Figure 7B:
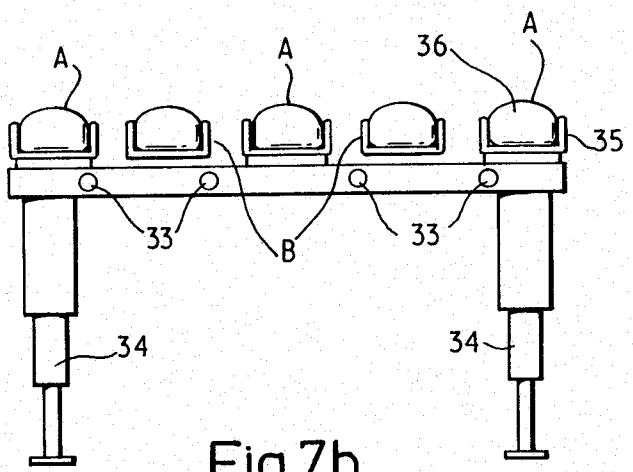

The principle set out in FIGS. 6*a* and 6*b* is also applicable to square work roadway supports as shown in FIGS. 7*a* and 7*b*. Cross members 32 are slidably mounted on guide bars 33 and hydraulic support legs 34 are provided. Channel members 35 extend between the cross members 32 and each channel member 35 contains an elongate inflatable bag 36.

To assist advancement along a roadway heading, the channel members marked A may be connected together for advancement as a unit, the channel members marked B, alternate with members A, also being connected together for advancement as a separate unit. The two units are advanced alternately. The channel members of the embodiment of FIGS. 6*a* and 6*b* may be arranged similarly.

The invention is not restricted to the details of the foregoing embodiments.

I claim:

1. An underground support device comprising:

(a) hydraulic drive means;

(b) a substantially rigid support structure movable by the hydraulic drive means between a first position in which the substantially rigid support structure is spaced away from a surface to be supported and a second position in which the substantially rigid support structure is adjacent to the said surface;

(c) Control means controlling said hydraulic drive means;

(d) flexible membrane means mounted on said rigid support structure;

(e) fluid pressure means operable to inflate the membrane, hence shaping the flexible membrane means to said surface and distributing the loading evenly thereto.

2. An underground support device as claimed in claim 1, in which the said hydraulic drive means and the said fluid pressure means are interconnected.

3. An underground support device as claimed in claim 1, in which the flexible membrane means comprises at least one inflatable bag.

4. An underground support device as claimed in claim 1, in which the flexible membrane means comprises at least one sheet of material sealed to the support structure around the sheet edges.

5. An underground support device as claimed in claim 1, in which the flexible membrane means is constructed of flexible synthetic material with reinforcing means embedded therein.

6. An underground support device as claimed in claim 1, comprising a hydraulic roof support having a base, a roof engaging unit, at least one hydraulic leg extending between the base and the roof engaging unit, the flexible membrane means being mounted on the upper face of the roof engaging unit.

7. An underground support device as claimed in claim 6, in which the flexible membrane means is located in at least one recess in the roof engaging unit, and the depth of the recess is related to the thickness of the uninflated flexible membrane means such that the uninflated flexible membrane means does not project above the upper face of the roof engaging unit.

8. An underground support device as claimed in claim 6, in which the flexible membrane means is inflatable as a separate operation from hydraulic operation of the leg, for example so that after the roof engaging unit has been set against the surface to be supported with a predetermined pressure, the flexible membrane means can be inflated to fill any gaps between the roof engaging unit and the surface to be supported.

9. An underground support device as claimed in claim 6, in which the flexible membrane means is inflatable as an operation related to the hydraulic operation of the leg.

10. An underground support device as claimed in claim 9, in which the inflation of the flexible membrane means is controlled by a valve which comes into operation when the pressure in the leg reaches a predetermined value.

11. An underground support device as claimed in claim 6, in which a separate fluid supply is provided for the flexible membrane means.

12. An underground support device as claimed in claim 6, in which the fluid supply for the flexible membrane means and the hydraulic supply for the leg are linked together such that lowering of the leg causes the pressure and volume of fluid in the flexible membrane means to fall and the flexible membrane means to at least partially empty, and raising the leg causes the pressure and volume of fluid in the flexible membrane means to rise.

13. An underground support device as claimed in claim 6, in which the pressure in the flexible membrane means is controlled such that if it rises above a predetermined limit, the leg lowers slightly to reduce the pressure and/or volume of fluid in the flexible membrane means.

14. An underground support device as claimed in claim 1, in which the flexible membrane means is mounted at at least one side of a hydraulic roof support to provide side sealing between adjacent roof supports to prevent material flushing between the supports.

15. An underground support device as claimed in claim 1, in which the flexible membrane means is mounted on an extension bar which is extendable from the roof engaging beam or canopy of a hydraulic roof support.

16. An underground support device as claimed in claim 15, in which the extension bar comprises a channel member with the mouth of the channel facing upwardly, the flexible membrane means being accommodated in the channel.

17. An underground support device as claimed in claim 1, comprising a roadway support of the form having hydraulic legs and being advanceable with a mine roadway heading.

* * * * *